US006145427A

United States Patent [19]

Smith

[11] Patent Number: 6,145,427

[45] **Date of Patent: *Nov. 14, 2000**

[54] APPARATUS AND METHOD FOR CUTTING BAGELS

[76] Inventor: Daniel C. Smith, 44 Ashton La., South Hadley, Mass. 01075

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,760

[22] Filed: Jun. 26, 1997

Related U.S. Application Data

[63] Continuation of application No. 08/567,268, Dec. 15, 1995, abandoned.

[51] Int. Cl.[7] ..... B26D 1/06; B26D 3/30

[52] U.S. Cl. ..... 83/874; 83/167; 83/370; 83/425.3; 83/427; 83/431; 83/435.8; 83/437.5; 83/444; 83/449; 83/932

[58] Field of Search ..... 83/870, 762, 167, 83/444, 446, 449, 437.1, 932, 751, 425.3, 856, 858, 764, 874, 454, 437.2, 437.5, 72, 162, 360, 365, 370, 372, 373, 732, 415, 427, 431, 435.11, 435.15, 458, 435.18, 465, 435.23, 440, 441.1, 783, 618, 620, 672, 412, 420; 30/503, 503.5, 392, 393, 394; 99/537, 391

[56] References Cited

U.S. PATENT DOCUMENTS

| | | | |
|---|---|---|---|
| 67,325 | 7/1867 | Madden | 83/165 |
| 1,217,717 | 2/1917 | Decker et al. | 83/437 |
| 1,847,857 | 3/1932 | Ames | 83/420 |
| 2,095,620 | 10/1937 | Tuthill et al. | 83/751 |
| 2,235,546 | 3/1941 | Ahrndt | 83/872 |
| 2,279,376 | 4/1942 | Marriott . | |
| 2,685,901 | 8/1954 | Putzer | 83/870 |
| 3,774,487 | 11/1973 | Topliffe | 83/437 |
| 3,834,261 | 9/1974 | Behrendt | 83/420 X |
| 3,875,840 | 4/1975 | Moorman | 83/751 |
| 4,132,256 | 1/1979 | Jones | 144/253 |
| 4,249,445 | 2/1981 | Browning . | |
| 4,434,692 | 3/1984 | Desert et al. | 83/72 |
| 4,546,686 | 10/1985 | Losiowski et al. . | |
| 4,649,781 | 3/1987 | Holz . | |
| 4,662,257 | 5/1987 | Peterson et al. | 83/751 X |
| 4,747,331 | 5/1988 | Policella . | |
| 4,955,271 | 9/1990 | Boutin-Lester . | |
| 4,958,547 | 9/1990 | Low | 83/DIG. 1 |
| 5,095,791 | 3/1992 | Jongerius | 83/420 X |
| 5,313,800 | 5/1994 | Morikawa et al. | 99/537 |
| 5,337,480 | 8/1994 | Codikow | 83/437 |
| 5,431,078 | 7/1995 | Ricard et al. . | |
| 5,440,959 | 8/1995 | Bindon et al. | 83/167 |
| 5,598,759 | 2/1997 | Sie et al. | 83/762 |
| 5,690,013 | 11/1997 | Kanarek et al. | 83/762 |
| 5,732,610 | 3/1998 | Halladay et al. | 83/871 |

FOREIGN PATENT DOCUMENTS

| | | | |
|---|---|---|---|
| 2510025 | 1/1983 | France | 30/392 |
| 812225 | 8/1951 | Germany | 83/437 |
| 3345315 | 10/1984 | Germany | 83/444 |

*Primary Examiner*—Rinaldi I. Rada
*Assistant Examiner*—Boyer Ashley
*Attorney, Agent, or Firm*—Bachman & Lapointe, P.C.

[57] ABSTRACT

An apparatus for slicing a food product includes a housing having a food product inlet and a food product outlet and a food product path defined therebetween. A reciprocating cutter is positioned within the housing along the food product path between the food product inlet and the food product outlet. A pusher element is provided for pushing a food product along the food product path against the reciprocating cutter whereby the cutter slices the food product.

18 Claims, 3 Drawing Sheets

APPARATUS AND METHOD FOR CUTTING BAGELS

This is a continuation of application(s) Ser. No. 08/567,268 filed on Dec. 5, 1995 now abandoned.

BACKGROUND OF THE INVENTION

The invention relates to an apparatus and method for slicing food products, especially bagels.

The slicing of bagels and other food products presents several persistent problems which present long standing needs in the art. First of all, numerous injuries are reported each year resulting from accidents during the slicing of bagels. Furthermore, manually slicing bagels by hand frequently results in uneven slices, and is time consuming.

Various proposals have been made attempting to deal with safety, evenness and efficiency with which bagels and other food products can be sliced. Representative of these efforts are U.S. Pat. Nos. 5,431,078, 4,955,271, 4,747,331, 4,649,781, 4,546,686, 4,249,445, and 2,279,376. However, despite the prior efforts in this field, the need remains for an apparatus and method for slicing and cutting bagels wherein safety of the user is ensured, uniform even slices are provided, and the slicing or cutting procedure is automated so as to increase the efficiency with which bagels can be cut.

It is therefore the primary object of the present invention to provide an apparatus for cutting bagels wherein the cutting element is at all times shielded from contact with the hands of a user.

It is a further object of the invention to provide an apparatus for cutting bagels wherein bagels of various sizes are automatically centered with respect to the cutting element.

It is still another object of the present invention to provide an apparatus for cutting bagels wherein the cutting procedure is simple and automated.

It is a further object of the present invention to provide an apparatus for cutting bagels wherein cleaning of the apparatus is facilitated.

It is a still further object of the present invention to provide a method for cutting bagels which accomplishes the aforedescribed objectives.

Other objects and advantages will appear hereinbelow.

SUMMARY OF THE INVENTION

In accordance with the invention, the foregoing objects and advantages are readily attained.

According to the invention, an apparatus for cutting food products such as bagels is provided which comprises a housing having a food product inlet and a food product outlet and a food product path defined therebetween, reciprocating cutting means positioned within said housing along said food product path between said food product inlet and said food product outlet, means for pushing a food product along said food product path against said reciprocating cutting means whereby said cutting means slices said food product.

Furthermore, a method for cutting bagels is provided which comprises the steps of providing a food product path and a reciprocating cutting means positioned along said path, pushing a food product along said food product path into contact with said cutting means, and reciprocating said cutting means whereby said food product is sliced.

BRIEF DESCRIPTION OF THE DRAWINGS

A detailed description of preferred embodiments of the invention follows, with reference to the accompanying drawings, wherein.

DETAILED DESCRIPTION

The invention relates to a method and apparatus for cutting food products, especially bagels and the like. Referring now to the accompanying drawings, preferred embodiments of the invention will be described.

Figure 1:
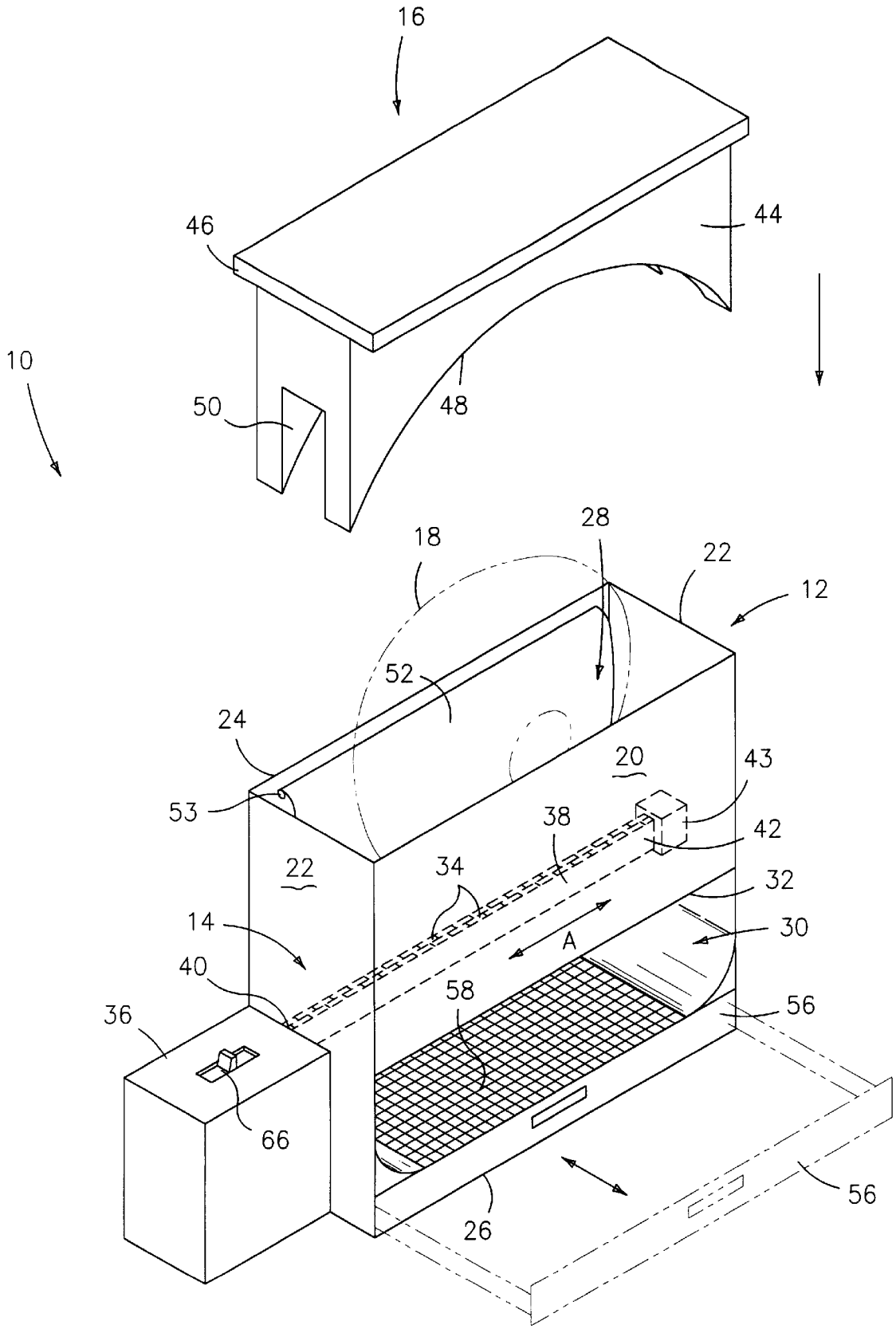
FIG. 1 is a perspective view of an apparatus for cutting bagels according to the invention.
Figure 5:
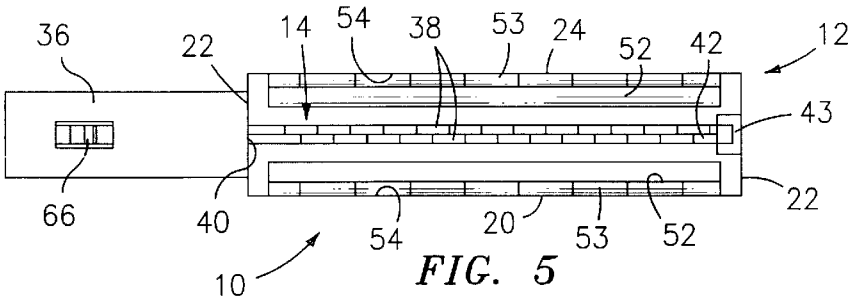
FIG. 5 is a top schematic view of an apparatus according to the invention.

FIG. 1 illustrates a perspective view of an apparatus 10 for cutting bagels and other food products 18 in accordance with the invention. As shown in FIG. 1, apparatus 10 preferably includes a housing 12, a cutting element 14 reciprocably disposed within housing 12, and a pusher element 16 for pushing a bagel or other food product 18 through housing 12 and into contact with cutting element 14.

Housing 12 preferably comprises a front wall 20, side walls 22, a back wall 24 and a base 26. According to the invention, front, side, and back walls 20, 22, 24 are joined at edges thereof and to base 26 so as to define a housing inlet 28 for receiving food products to be cut or sliced in accordance with the invention, and a housing outlet 30 for ejecting or exiting food products which have been cut or sliced in accordance with the present invention. As shown in FIG. 1, housing 12 may preferably be arranged so as to be substantially vertically oriented, having housing inlet 20 at a top portion thereof. Further, and also as shown in FIG. 1, housing outlet 30 may be positioned facing forward on housing 12 as shown, and defined by a bottom or outlet edge 32 of front wall 20 spaced from base 26 so as to define outlet 30 in conjunction with front edges of side walls 22. Of course, housing 12, inlet 28 and outlet 30 may have alternative arrangements and orientations in accordance with the invention. Further, base 26 preferably extends laterally from housing 12 for enhanced stability.

Cutting element 14 is preferably at least one and preferably two reciprocating blades positioned within housing 12 and having cutting surfaces 34 facing toward housing inlet 28. A motive means 36 such as an electric motor or other apparatus is preferably provided so as to reciprocate cutting element 14 substantially transverse or perpendicular to a path of motion of a bagel 18 through housing 12. For example, motive means 36 may suitably reciprocate cutting element 14 as illustrated by Arrow A in FIG. 1. Cutting element 14 preferably comprises two cutting blades 38, as set forth above, which are reciprocated in alternating opposite directions by motive means 36. In further accordance with the invention, cutting blades 38 are preferably provided so that cutting surfaces 34 thereof are entirely within housing 12 at all times during operation. Thus, and advantageously, cutting surfaces 34 of cutting element 14 are not exposed at any time during a bagel cutting operation, and safety during use is thereby greatly enhanced.

Cutting element 14 is preferably supported within housing 12 at both ends 40, 42, for example by a low friction sleeve element 43 preferably made of nylon or other suitable material, and sleeve 43 may be replaceable if desired.

It should be noted that the provision of two cutting blades 38 reciprocated in alternating opposite directions is advantageous in accordance with the invention as a maximum relative velocity of one blade with reference to the other is achieved with a minimum amount of required reciprocation of either cutting blade 38 outside of housing 12. This is desirable because limiting the actual reciprocating motion of each blade 38 limits the extent to which blades 38 protrude from housing 12 and therefore also limits the size of dulled end portions 40 or caps 42. For example, with two blades 38 as shown, the horizontal travel of each blade 38 during reciprocation would be about ¼ inch.

In further accordance with the invention, it should be noted that the provision of reciprocated cutting blades 38 for use in cutting bagels and other food products is further advantageous in that reciprocating blades are more suitably adapted to cutting food products which are relatively hard at an outer surface, such as bagels which may be several days old, and the like. This is advantageous as compared to bagel slicing devices which are known in the art, and which typically use a fixed blade which would be ineffective in cutting such hard-surfaced bagels.

Figure 4:
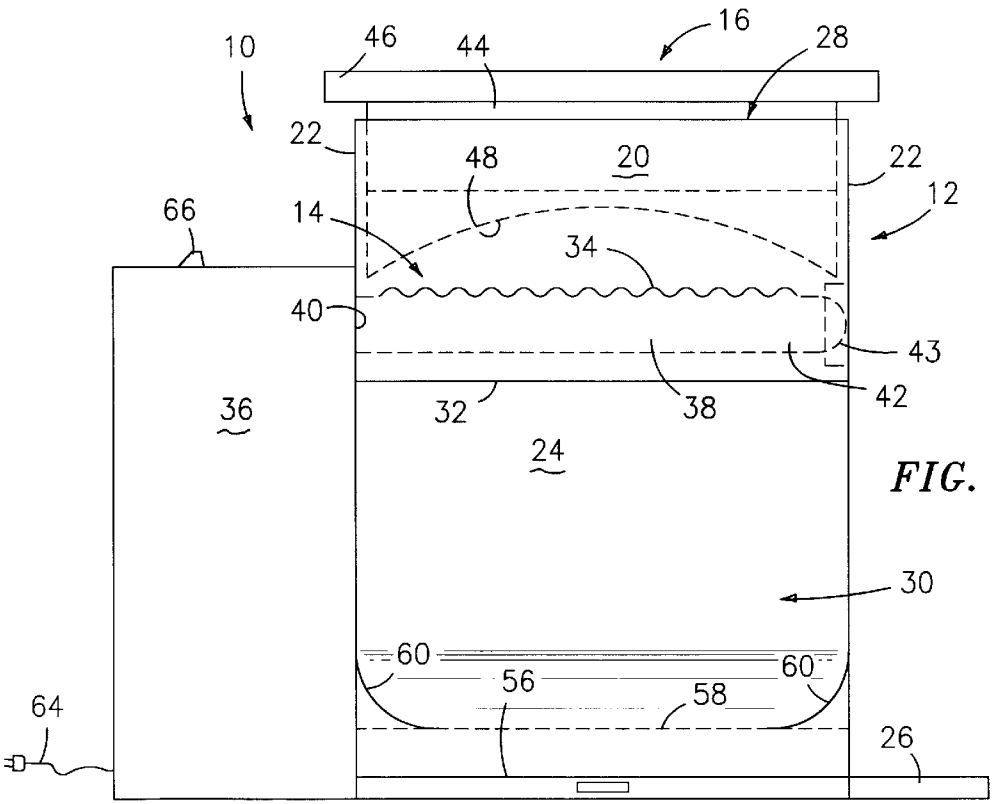
FIG. 4 is a front sectional schematic view of an apparatus according to the invention.

Pusher element 16 is preferably a simple body member 44 having a cap or top flange 46 and a food product contact surface 48 extending therefrom. As shown in FIG. 1, contact surface 48 is preferably shaped so as to generally correspond to the shape of an anticipated food product to be cut or sliced. Furthermore, pusher element 16 preferably has a groove 50 disposed on contact surface 48 for accommodating cutting element 14 when pusher element 16 is disposed completely into housing 12. See, for example, FIG. 4. Flange 46 advantageously serves to limit inward motion of pusher 16 relative to housing 12 when flange 46 contacts housing 12, thereby preventing over-insertion of pusher 16 and enhancing safety of use of apparatus 10.

Figure 2:
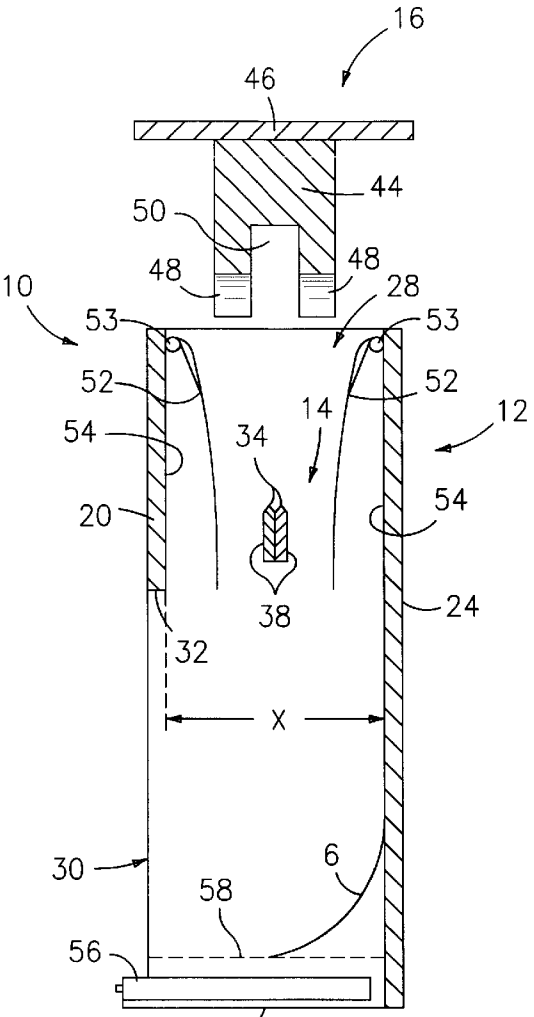
FIG. 2 is a side sectional view of an apparatus according to the invention.

Referring now particularly to FIGS. 1 and 2, additional features of housing 12 in accordance with the invention will be described. A problem in the automatic cutting or slicing of bagels and related food products is centering the food product with respect to the cutting element. For example, bagels come in a wide variety of widths. In accordance with the present invention, housing 12 preferably has a sufficient depth X (FIG. 2) to accommodate the widest expected size of bagels. In order to accommodate bagels and food products of a lesser width, spring biased plates 52 are preferably positioned on inner opposing surfaces 54 of front wall 20 and back wall 24. Plates 52 preferably have a convex curved surface facing inwardly toward cutting element 14, and may preferably be mounted to housing 12 at a pivot 53 which is most suitably spring mounted. Of course, plates 52 may be spring biased or otherwise resiliently displaceably positioned in any manner known to one of ordinary skill in the art. Plates 52 serve to contact side surfaces of a food product to be cut in apparatus 10, and thereby center the food product with respect to cutting element 14.

Housing 12 is preferably further provided with a tray 56 slidably and preferably removably positioned within base 26 and beneath cutting element 14. Tray 56 serves to catch crumbs and other debris resulting from the cutting or slicing operation, and the removable or slidable nature of tray 56 allows this element to be removed for convenient cleaning. Furthermore, a grate or screen 58 is also preferably positioned within housing 12 and beneath cutting element 14 to catch a bagel or other food product after a cutting procedure is completed. Grate 58 preferably serves to catch the food product or bagel being cut, while allowing crumbs, loose toppings and other debris from the cutting operations to pass through grate 58 and into tray 56.

In further accordance with the invention, the inner surfaces of housing 12 are preferably provided with rounded corners, particularly at junctions between walls 20, 22, 24 and, preferably, base 26. Rounded corners 60 (FIG. 4) serve to facilitate cleaning and avoid the difficulty associated with removing crumbs and other cutting debris from internal corners of the device according to the invention. Furthermore, back wall 24 preferably has a rounded or sloped surface 62 (FIG. 2) substantially adjacent to grate 58 which, according to the invention, serves to urge a bagel or other food product toward outlet 30 after completion of the cutting operation, and also facilitates cleaning in a similar manner to rounded corners 60.

In further accordance with the invention, the reciprocating action of cutting element 14 is preferably powered by motive means 36 which may be, for example, an electric motor. Motive means 36 may suitably be powered by standard wall voltage through a conventional plug member 64 (FIG. 4) or may be battery operated or powered by any other source which may be desirable. In a simple embodiment, reciprocation of cutting element 14 may be directly controlled by an on/off switch 66, for example positioned on a housing of motive means 36. In this simple embodiment, reciprocation of cutting element 14 is positively and directly controlled by on/off switch 66.

In accordance with a preferred embodiment of the invention, apparatus 10 is provided with a sensor 68 (FIG. 3) for sensing a food product contacting cutting element 14, and for activating a motor 70 for reciprocating cutting element 14. Sensor 68 may, for example, be activated by downward force indicated by Arrow B upon cutting element 14. Thus, when a bagel is pressed against cutting element 14, a downward force in the direction of Arrow B activates sensor 68 which, in turn, activates motor 70 to initiate reciprocating and, thereby, the cutting of a bagel. After the cutting procedure is completed, the downward force indicated by Arrow B is removed, sensor 68 is inactivated, and reciprocation of cutting element 14 is stopped. Sensor 68 may, for example, be a simple contact switch or other mechanism activated by the downward force indicated by Arrow B. Alternatively, sensor 68 could be an electric eye positioned to sense the presence of an object in housing inlet 28 or may be a cam switch positioned to be contacted by either (1) a bagel or food product, or (2) pusher element 16.

Figure 6:
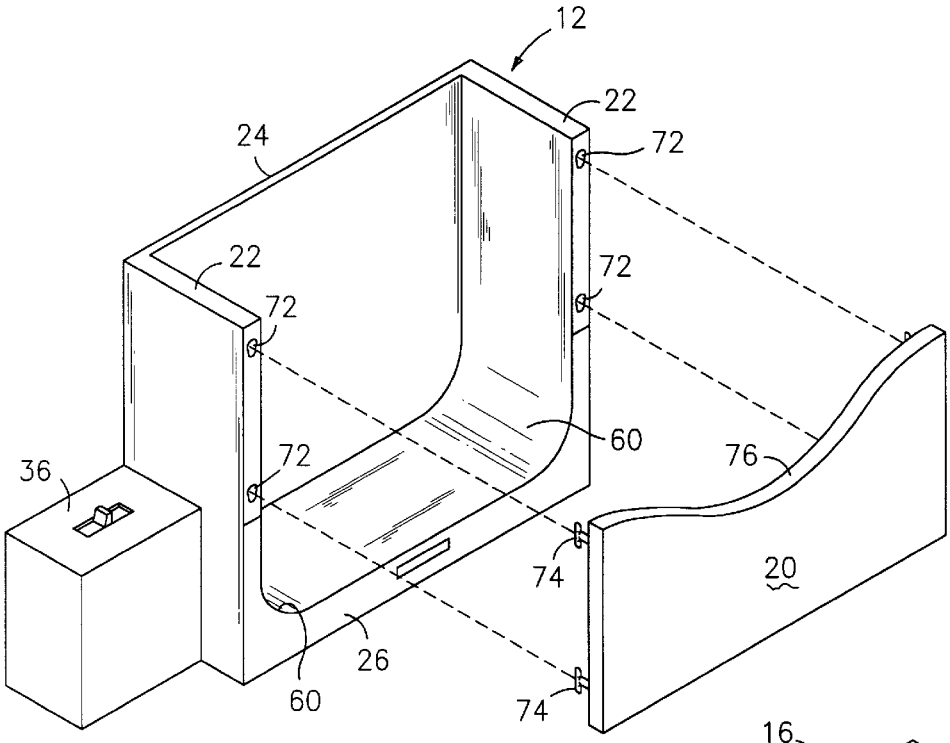
FIGS. 6 and 7 are perspective views of alternate embodiments of the invention.

Referring now to FIG. 6, front wall 20 in accordance with the invention is preferably removably mounted to housing 12 so as to facilitate cleaning. As shown in FIG. 6, front wall 20 may be mounted through the use of slots 72 preferably positioned or oriented facing forward on sidewalls 22. Front wall 20 in accordance with this embodiment is preferably also provided with knobs 74 or other members adapted to fit releasably within slots 72. As shown in FIG. 6, slots 72 may preferably have a profile having a narrower portion for example at a lower portion thereof, and having a wider portion at the upper portion thereof. As will become readily apparent from FIG. 6, such a configuration allows front wall 20 to be removed by lifting the wall to align knobs 74 with the wider portion of slots 72, and then outwardly removing front wall 20. Of course, numerous other latch or holding mechanisms can be used to hold front wall 20 releasably in place as desired.

In accordance with a further alternative embodiment of the present invention, front wall 20 may be provided with a cutout upper edge 76 which is contoured so as to facilitate the insertion of a bagel. This is advantageous as cutout 76 may suitably be arranged so as to allow insertion of a bagel or other food product to be sliced without removing pressure element 16.

Figure 7:
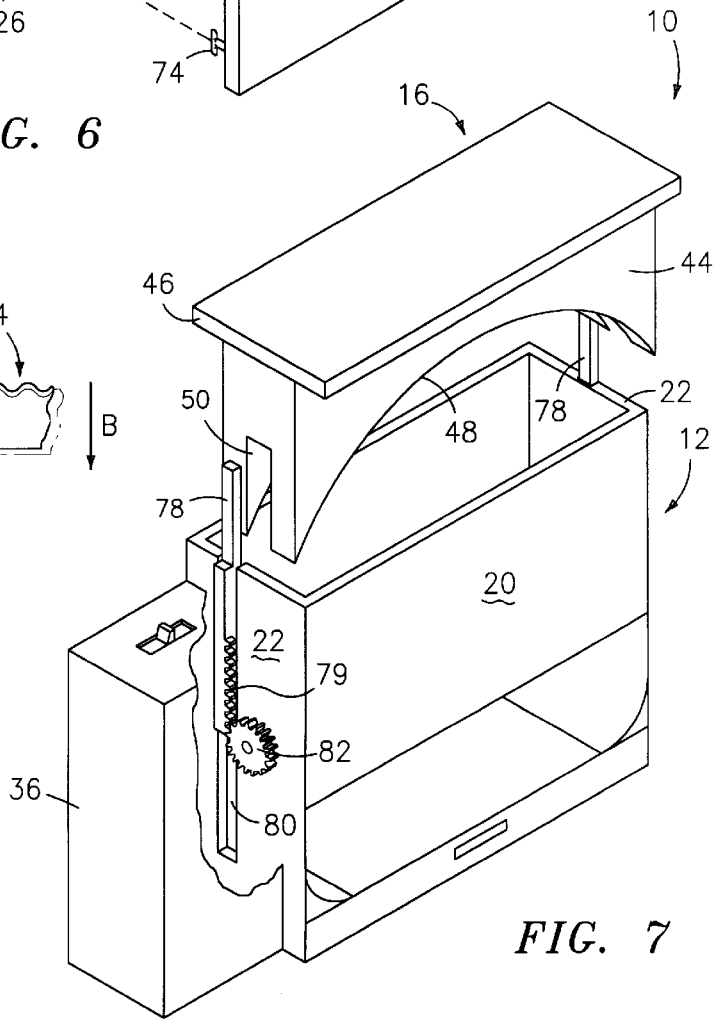

Referring now to FIG. 7, a further alternative embodiment of the present invention is schematically illustrated. In accordance with the invention, pusher element 16 is mounted in an auto-feed manner so as to automate the pushing function of pusher element 16 on a bagel or food product to be cut using apparatus 10. As shown in FIG. 7, pusher element 16 may suitably be provided with one or more geared rods 78, preferably downwardly extending from side surfaces thereof. Housing 12 may also suitably be provided with tracks 80 to receive and guide rods 78 for upward and downward motion of pusher element 16 as desired. In further accordance with the invention, a motor driven gear 82 may also be positioned preferably within housing 12, and in engagement with rods 78 so as to drive pusher element 16 into and out of housing 12 as desired. Rods 78 may suitably be provided with a toothed on geared surface 79 for engaging gear 82. Motor driven gear 82 may suitably be powered by motive means 36, or by an additional motor or other element (not shown).

Motor driven gear 82 may be driven so as to operate in both directions, thereby providing driven motion of pusher element 16 both into and out of housing 12. Alternatively, motor driven gear 82 may be driven in a single direction, engaging with rods 78 so as to pull pusher element 16 into housing 12, and a release member may be arranged within housing 12 so as to disengage rods 78 when pusher element 16 completes a cycle toward cutting blades 38. In this embodiment, after release of rods 78 from gear 82, pusher element 16 may be manually raised for the next operation, or a spring mechanism could be positioned within housing 12 to raise pusher element 16 after rods 78 are released from gear 82.

Figure 3:
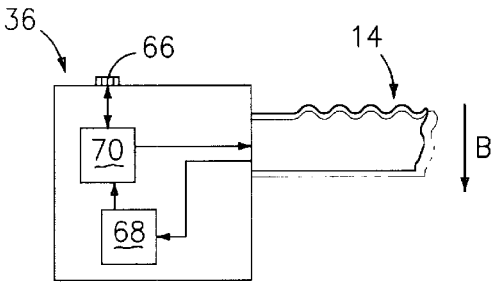
FIG. 3 is a side schematic view of a portion of an apparatus according to the invention.

Although the embodiment of FIG. 7 in its own is a desirable embodiment, it is of course also possible to combine the embodiment of FIG. 7 with the embodiment of FIG. 3 so as to provide a fully automated apparatus 10 in accordance with the invention.

It should be readily apparent that disclosed herein is a method and apparatus for cutting bagels and other food products which readily accomplishes each of the foregoing objects and advantages. It is to be understood that the invention is not limited to the illustrations described and shown herein, which are deemed to be merely illustrative of the best modes of carrying out the invention, and which are susceptible to modification of form, size, arrangement of parts and details of operation. The invention rather is intended to encompass all such modifications which are within its spirit and scope as defined by the claims.

What is claimed is:

1. An apparatus for slicing a food product, comprising:

a housing having a base, a front wall, a back wall and two side walls;

said front wall, said back wall and said two side walls having upper edges defining a food product inlet having a depth defined between said front wall and said back wall and a width defined between said two side walls, said width being larger than said depth;

said housing further having a food product outlet;

said inlet, said housing and said outlet defining a straight food product path extending between said front wall and said back wall and from said inlet to said outlet;

said base being adapted to rest on a flat horizontal surface with said inlet above said outlet;

reciprocating cutting means for slicing said food product, said cutting means extending from one of said two side walls to the other of said two side walls parallel to and spaced between said front wall and said back wall and defining a single cutting plane between and parallel to said front wall and said back wall and below said inlet;

centering means for centering said food product between said front wall and said back wall, said centering means comprising a centering member associated with said front wall and said back wall and extending along said food product path and inwardly toward said single cutting plane; and means for pushing said food product along said food product path between said front wall and said back wall and from said inlet against said cutting means and toward said outlet whereby said cutting means slices said food product into two parts, said means for pushing comprising a push member positionable within said inlet and slidable along at least a portion of said food product path and having a pushing surface for contacting said food product.

2. An apparatus according to claim 1, wherein said cutting means has a cutting surface and is reciprocably mounted within said housing for reciprocation during cutting, and wherein said cutting surface is within said housing during reciprocation of said cutting means.

3. An apparatus according to claim 1, wherein said pushing surface has a recess for receiving said cutting means.

4. An apparatus according to claim 1, wherein said pushing surface is contoured to a shape of a food product.

5. An apparatus according to claim 1, wherein said cutting means comprises at least one blade positioned within said housing, fixed in a direction parallel to said food product path and reciprocable in a direction transverse to said food product path.

6. An apparatus according to claim 1, wherein said housing comprises housing elements including said front wall, said back wall, said two side walls and said base joined together to define said food product path and corners between said housing elements, and wherein an inner surface of said housing is rounded at said corners whereby cleaning of said housing is facilitated.

7. An apparatus according to claim 1, wherein said housing includes a removable front wall portion, and further comprising means for releasably attaching said front wall portion to said housing, whereby cleaning of an interior of said housing is facilitated.

8. An apparatus according to claim 1 wherein said centering means comprises resiliently displaceable means extending resiliently inward in said housing.

9. An apparatus according to claim 1, wherein said cutting means comprises two cutting blades reciprocably positioned in said housing for cutting along said single cutting plane, and wherein said cutting means further comprises means for reciprocating said two cutting blades in opposite relative directions, said two cutting blades having a total width, and said width of said inlet being substantially the same as said total width of said two cutting blades.

10. An apparatus according to claim 9, further comprising means associated with said cutting means for sensing a food product contacting said cutting means and for activating said means for reciprcating upon sensing said food product contacting said cutting means.

11. An apparatus according to claim 10, wherein said means for sensing further comprises means for inactivating said means for reciprocating when said food product is not contacting said cutting means.

12. An apparatus according to claim 1, wherein said front wall is connected to said two side walls and has an outlet edge spaced from said base whereby said food product outlet is defined by said outlet edge, said base, and front edges of said side walls.

13. An apparatus according to claim 12, wherein said back wall slopes toward said food product outlet whereby a food product is urged through said food product outlet after passing said cutting means.

14. An apparatus according to claim 1, further comprising means for collecting food product crumbs, said means for collecting being slidably positioned within said housing and being slidable between an operating position wherein said means for collecting is positioned beneath said cutting means and a cleaning position wherein said means for collecting is substantially removed from said housing for cleaning whereby removal of food product crumbs is facilitated.

15. An apparatus according to claim 14, further comprising grate means, positioned above said means for collecting in said operating position, for catching a food product and allowing food product crumbs to pass to said means for collecting.

16. An apparatus for slicing a food product, comprising:

a housing having a base, a front wall, a back wall and two side walls;

said front wall, said back wall and said two side walls having upper edges defining a food product inlet having a depth defined between said front wall and said back wall and a width defined between said two side walls, said width being larger than said depth;

said housing further having a food product outlet;

said inlet, said housing and said outlet defining a straight food product path extending between said front wall and said back wall and from said inlet to said outlet;

said base being adapted to rest on a flat horizontal surface with said inlet above said outlet;

reciprocating cutting means for slicing said food product, said cutting means extending from one of said two side walls to the other of said two side walls parallel to and spaced between said front wall and said back wall and defining a single cutting plane between and parallel to said front wall and said back wall and below said inlet;

centering means for centering said food product between said front wall and said back wall, said centering means comprising a centering member associated with said front wall and said back wall and extending along said food product path and inwardly toward said single cutting plane;

means for pushing said food product along said food product path between said front wall and said back wall and from said inlet against said cutting means and toward said outlet whereby said cutting means slices said food product into two parts, said means for pushing comprising a push member positionable within said inlet and slidable along at least a portion of said food product path and having a pushing surface for contacting said food product;

at least one rod downwardly extending from said means for pushing; and drive means within said housing and engaging said rod for moving said means for pushing into said housing.

17. An apparatus according to claim 16, wherein said housing further includes track means for receiving said rod, and said drive means comprises a motor driven gear engaged with said rod.

18. An apparatus according to claim 17, wherein said rod has a geared surface for engaging said motor driven gear.

* * * * *